US005685211A

United States Patent [19]

Lax

[11] Patent Number: 5,685,211

[45] Date of Patent: Nov. 11, 1997

[54] SOAP DISPENSER

[76] Inventor: Jacob Lax, 1013 E. 26th St., Brooklyn, N.Y. 11210

[21] Appl. No.: 538,585

[22] Filed: Oct. 3, 1995

[51] Int. Cl.[6] ..... B26D 5/22

[52] U.S. Cl. ..... 83/224; 83/587; 83/649

[58] Field of Search ..... 83/649, 586, 587, 83/350, 223, 224, 949

[56] References Cited

U.S. PATENT DOCUMENTS

| | | | |
|---|---|---|---|
| 686,967 | 11/1901 | Guett | 83/587 |
| 998,561 | 7/1911 | Willis | 83/454 |
| 1,823,501 | 9/1931 | Messinger, Jr. | 83/587 |
| 2,792,885 | 5/1957 | Greene | 83/223 |
| 2,861,633 | 11/1958 | Schneider | 83/587 |
| 3,063,322 | 11/1962 | Thomas | 83/587 |
| 3,998,120 | 12/1976 | Granger et al. | 83/649 |
| 4,131,044 | 12/1978 | Cassia | 83/587 |
| 4,716,801 | 1/1988 | Spaller, Jr. | 83/586 |

*Primary Examiner*—Kenneth E. Peterson

*Attorney, Agent, or Firm*—Goodman & Teitelbaum, Esqs.

[57] ABSTRACT

A soap dispenser for feeding, cutting and dispensing a piece of dry ribbon soap from a supply spool, the soap dispenser including a base portion provided with a holding member for holding the supply spool with the ribbon soap rolled up thereon, and a cutting member coacting with a spring for cutting the ribbon soap. A cover portion is removably mounted on the base portion to enclose the supply spool therein, the cover portion being provided with a feeding member for feeding a length of the ribbon soap past the cutting member prior to cutting the ribbon soap. The feeding member includes a movable part provided with a cam for retracting the cutting member against the spring to tension the spring, the cam also releasing the cutting member when the spring is under tension so that the spring forces the cutting member into engagement with the ribbon soap for cutting off the length of ribbon soap. Preferably, the feeding member also includes a clutch so that the same predetermined uniform length of ribbon soap is fed each time for the cutting thereof, with each cut off length of ribbon soap being of the same size.

19 Claims, 3 Drawing Sheets

SOAP DISPENSER

BACKGROUND OF THE INVENTION

The invention relates to a soap dispenser and, more particularly, to a soap dispenser for feeding, cutting and dispensing a piece of dry ribbon soap, where the piece of dry ribbon soap preferably has a predetermined length so that all the dispensed pieces of soap have the exact same predetermined length.

Soap dispensers are well known in the art. However, most soap dispensers employ liquid soap which is usually splashed into the hands of the user. Though some types of prior art soap dispensers are supplied with a dry ribbon soap, these soap dispensers are similar to the conventional paper towel type dispenser, where a length of ribbon soap is dispensed by pulling down upon a lever, and then the user engages the dispensed ribbon soap against a cutting edge provided on the dispenser to cut the soap off from the supply spool thereof. In that the user cuts the ribbon soap, the user can dispense any desired length of ribbon soap before cutting same, so that the pieces of dispensed ribbon soap in the prior art are not of a predetermined uniform length.

Accordingly, there is presently a need for a soap dispenser for a dry ribbon soap, one that cuts the ribbon soap into predetermined uniform lengths, one that permits the ribbon soap to be easily replenished therein when it is depleted, one that is simple to use and one that is inexpensive to manufacture and maintain.

SUMMARY OF THE INVENTION

It is, accordingly, an object of the present invention to provide a soap dispenser which avoids the problems of the prior art soap dispensers.

Another object of the present invention is to provide a soap dispenser which can feed, cut and dispense a piece of dry ribbon soap.

A further object of the present invention is to provide a soap dispenser having a base portion for holding a supply spool of ribbon soap, and a removable cover portion mounted on the base portion to enclose the supply spool therein.

Still another object of the present invention is to provide a soap dispenser having cutting means within the base portion for cutting off a piece of the ribbon soap.

Another object of the present invention is to provide a soap dispenser having feeding means within the cover portion for feeding a length of the ribbon soap past the cutting means prior to the cutting of the ribbon soap.

Yet another object of the present invention is to provide a soap dispenser having cam means for retracting and releasing the cutting means so that the cutting means is spring biased into engagement with the ribbon soap for cutting off a length of the ribbon soap.

Another object of the present invention is to provide a soap dispenser having clutch means associated with the feeding means so that the same predetermined uniform length of ribbon soap is dispensed each time from the soap dispenser.

Briefly, in accordance with the present invention, there is provided a soap dispenser for feeding, cutting and dispensing a piece of dry ribbon soap from a supply spool, the soap dispenser including a base portion provided with holding means for holding the supply spool with the ribbon soap rolled up thereon, and cutting means coacting with a spring for cutting the ribbon soap. A cover portion is removably mounted on the base portion to enclose the supply spool therein, the cover portion being provided with feeding means for feeding a length of the ribbon soap past the cutting means prior to cutting the ribbon soap.

The feeding means include a movable member provided with cam means for retracting the cutting means against the spring to tension the spring, the cam means also releasing the cutting means when the spring is under tension so that the spring forces the cutting means into engagement with the ribbon soap for cutting off the length of ribbon soap. Preferably, the feeding means also includes clutch means so that the same predetermined uniform length of ribbon soap is fed each time for the cutting thereof, with each cut off length of ribbon soap being of the same size.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DESCRIPTION OF THE PREFERRED EMBODIMENT

Figure 1:
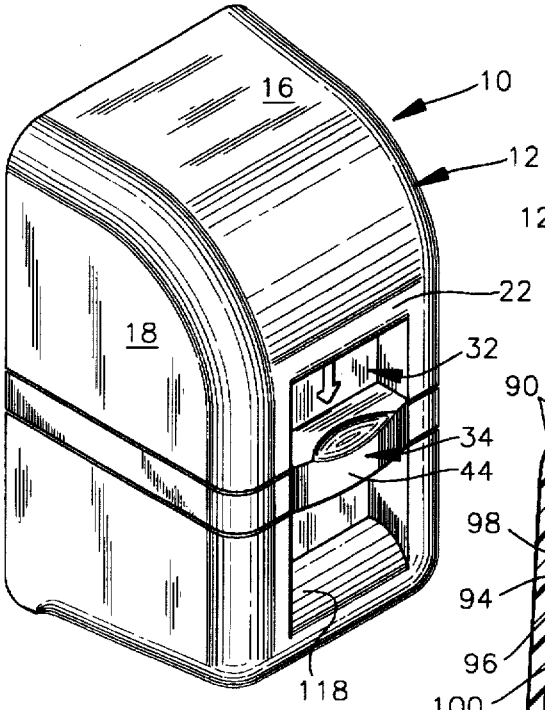
FIG. 1 is a perspective view of a soap dispenser in accordance with the present invention.
Figure 2:
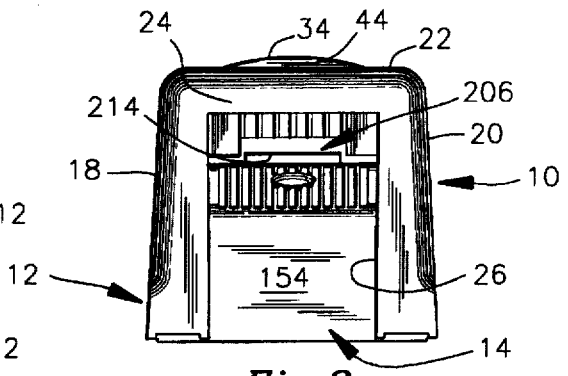
FIG. 2 is a bottom plan view of the soap dispenser of FIG. 1.
Figure 5:
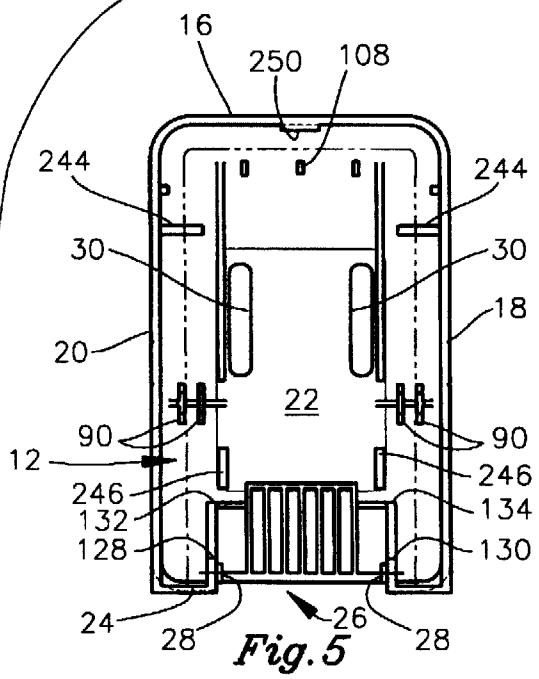
FIG. 5 is a rear view of the cover portion showing the inside thereof.
Figure 4:
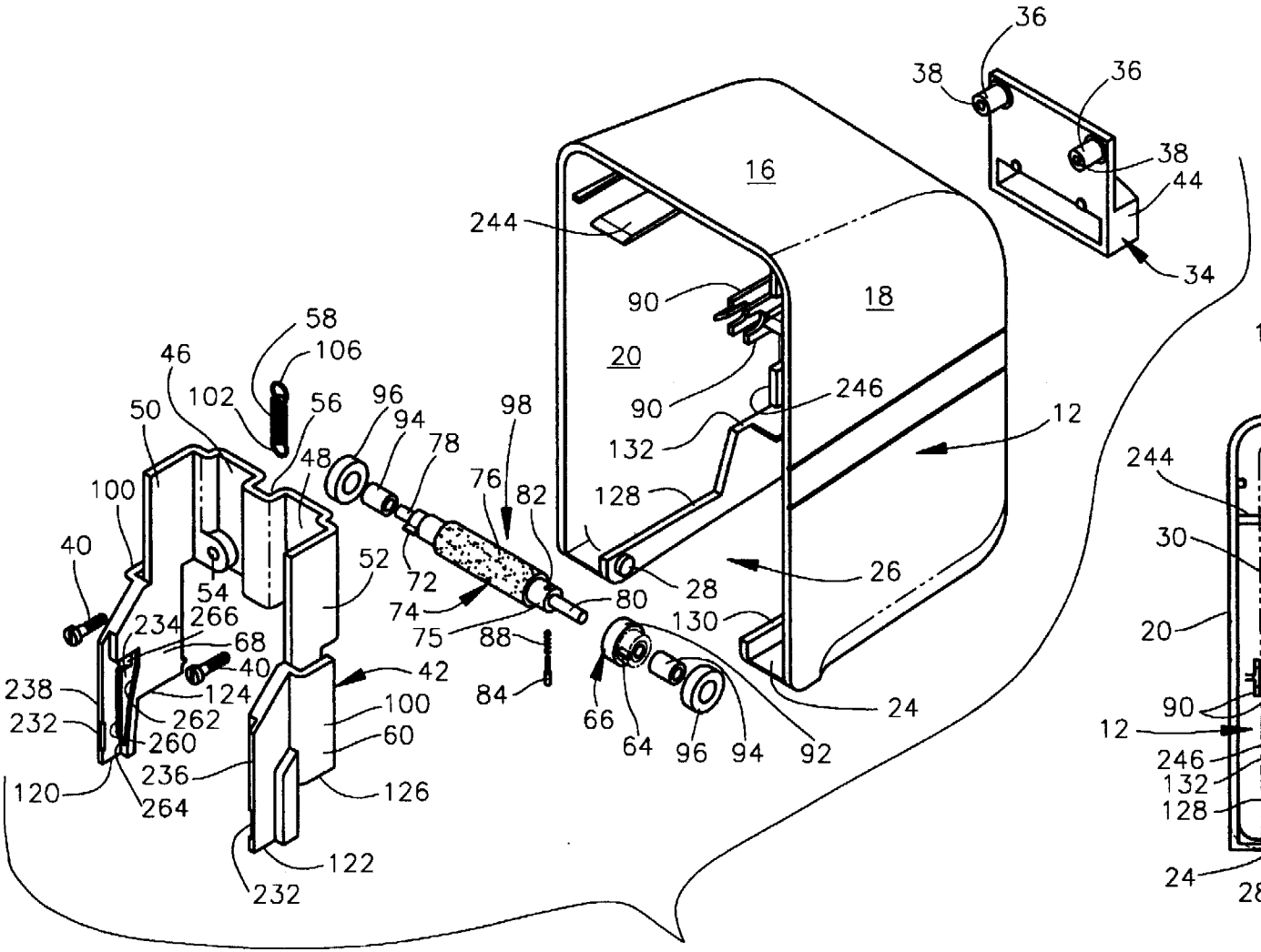
FIG. 4 is an exploded view of the parts connected to the cover portion of the soap dispenser.
Figure 10:
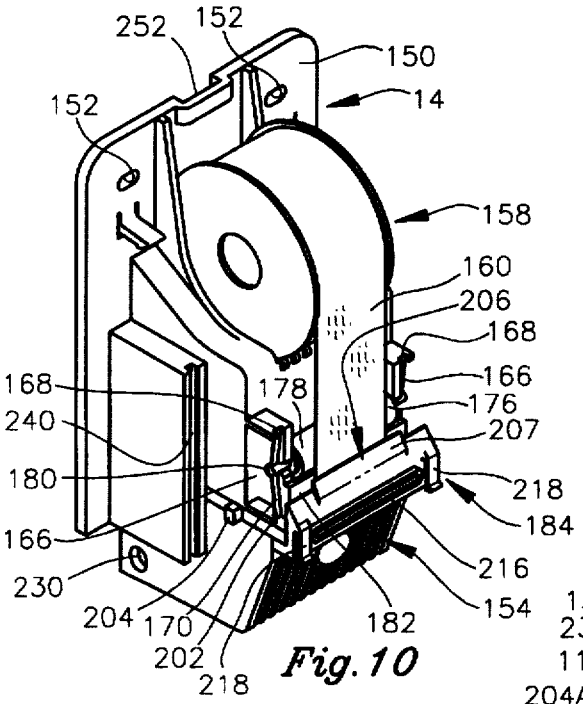
FIG. 10 is a perspective view showing the base portion of the soap dispenser.
Figure 11:
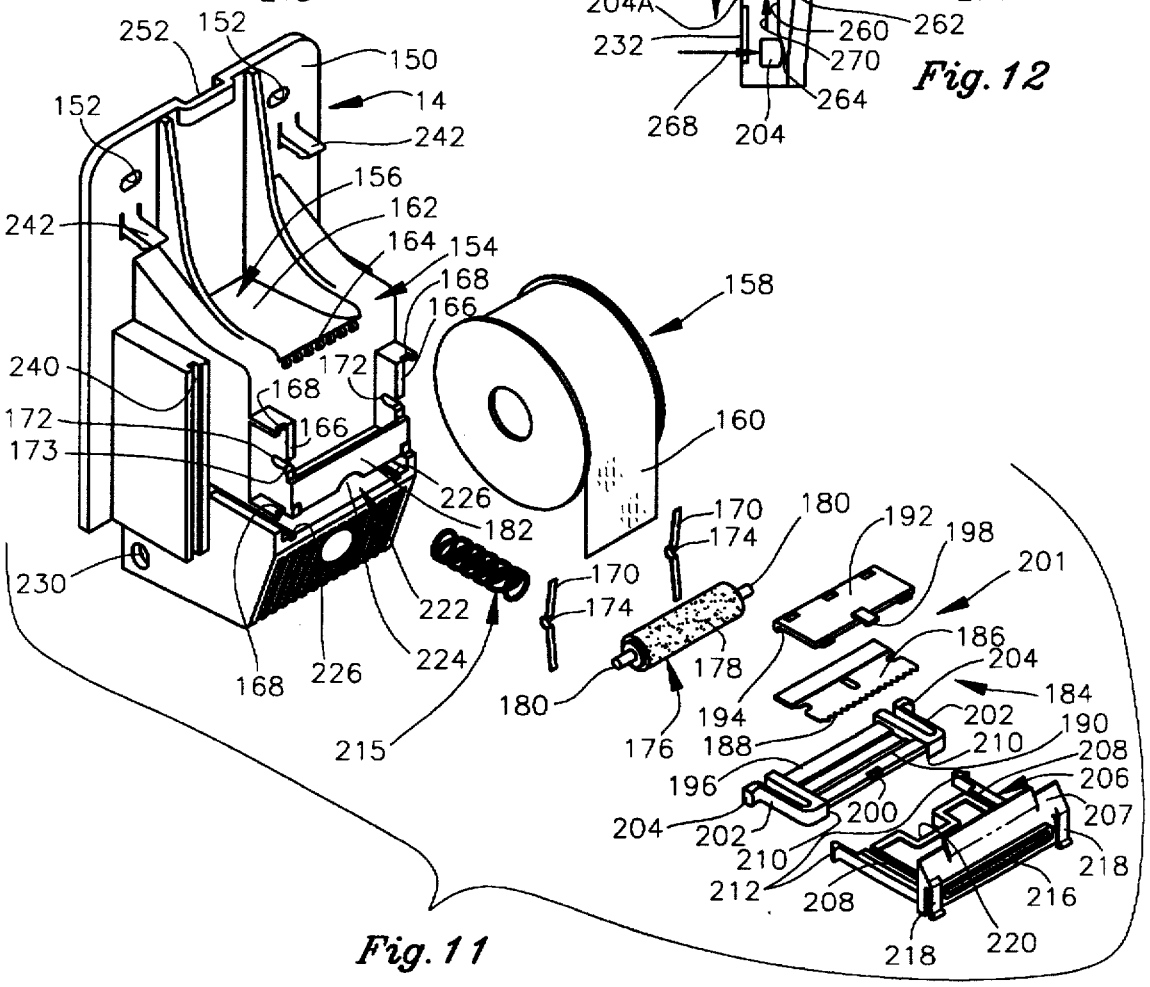
FIG. 11 is an exploded perspective view of the parts of the base portion shown in FIG. 10.

Referring now to the drawings, FIG. 1 shows a soap dispenser 10 to feed, cut and dispense a piece of dry ribbon soap from a supply spool, in accordance with the present invention, where FIG. 2 shows a bottom view thereof. The soap dispenser 10 includes a cover portion 12 as best shown in FIGS. 4 and 5, and a base portion 14 as best shown in FIGS. 10 and 11. As shown in FIGS. 1 and 2, the cover portion 12 almost completely conceals the base portion 14, where the cover portion 12 is pivotly mounted on the base portion 14 so that the supply spool of ribbon soap therein can be replaced, as will be described below.

As shown in FIGS. 1–5, the cover portion 12 includes a top wall 16, side walls 18, 20, a front wall 22 and a bottom wall 24, where the rear of the cover portion 12 is open, as shown best in FIG. 4. The bottom wall 24 has a rectangular opening 26 to receive a part of the base portion 14 so that a strip of ribbon soap drops through a portion of the opening 26 when the ribbon soap is cut, which will be described below in more detail. It is noted, that a pair of opposing pins 28 extend into the opening 26, as shown in FIGS. 4 and 5, to permit the cover portion 12 to be pivotly mounted onto the base portion 14, as will also be explained below.

Figure 3:
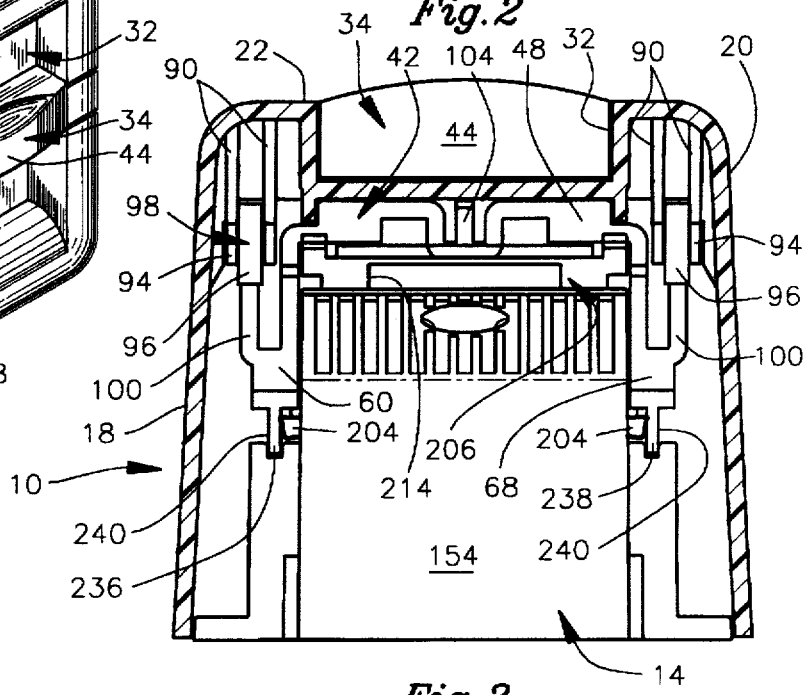
FIG. 3 is an enlarged sectional view taken through the soap dispenser shown in FIG. 2.

As best shown in FIG. 5, the front wall 22 has two spaced apart vertical slots 30 therethrough, where the slots 30 extend into a recess 32 formed in the front of the cover portion 12, shown in FIG. 1. A lever 34 is positioned in the recess 32, as shown in FIGS. 1 and 3, so that a pair of spaced apart protusions 36 on the rear of the lever 34, as shown in FIG. 4, can be inserted through the slots 30 for up and down movement therein, as will be explained below. The protrusions 36 have threaded holes 38 through the ends thereof to receive screws 40 to secure the lever 34 to a drive rack 42, as will be described below. Furthermore, the lever 34 has an L-shaped configuration to provide an enlarged base portion 44 extending outwardly from the front of the lever 34 which permits the lever 34 to be pushed downwardly, as will be further discussed below.

Figures 6, 9:
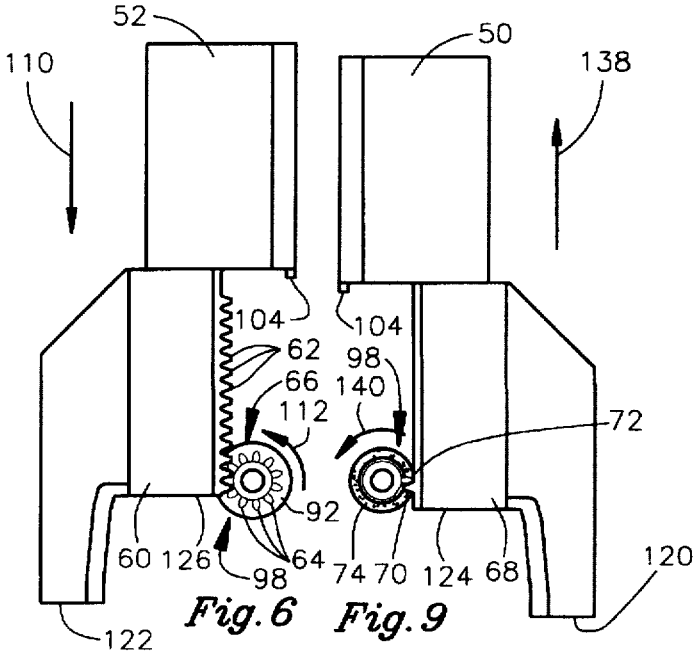
FIG. 6 is an enlarged side elevational view showing a first leg of the drive rack, shown in FIG. 4, rotating the drive gear.
FIG. 9 is an enlarged side elevational view, similar to FIG. 6, showing a single tooth on the second leg of the drive rack engaging a tooth provided on the drive roller.

The drive rack 42 has substantially a U-shaped body 46 including a bight portion 48 and legs 50, 52. The bight portion 48 has a pair of holes 54 therethrough to receive the screws 40. A central portion of the bight portion 48 is provided with a recess 56 to receive a coil spring 58 therein, as will be explained below. The leg 52 has a wing portion 60 which is provided with gear teeth 62 for engaging the gear teeth 64 on a drive gear 66, shown in FIG. 6, as will be explained below. The opposing leg 50 has a wing portion 68 provided with a single tooth 70 thereon as shown in FIG. 9, which co-acts with a single tooth 72 provided on the drive roller 74, as will be explained below.

Figure 7:
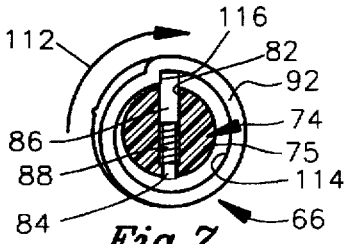
FIG. 7 is an enlarged side elevational view, partly in cross section, showing the clutch action which permits the drive gear to rotate the drive roller.
Figure 8:
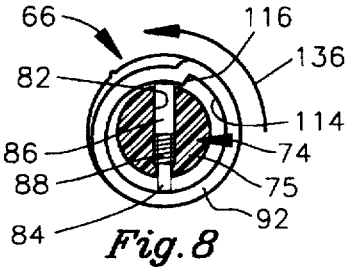
FIG. 8 is an enlarged side elevational view, partly in cross section, similar to FIG. 7, showing the disengagement of the clutch action when the drive gear is rotated in an opposite direction so that the drive roller does not rotate.

The drive roller 74, as best shown in FIG. 4, is preferably fabricated from a plastic material and has a rubber-like tubular member 76 mounted on a central portion thereof. A first shorter axle portion 78 extends longitudinally outwardly from one side of the drive roller 74, being adjacent to the tooth 72. A longer axle portion 80 extends outwardly from the opposite side thereof, where the cylindrical portion 75 of the drive roller 74 disposed between the tubular member 76 and the axle portion 80 has a stepped hole 82 therethrough, to provide a large bore communicating with a small bore, as best shown in FIGS. 7 and 8. A pin 84 having an enlarged head portion 86 is inserted into the stepped hole 82. Accordingly, a coil spring 88 is first positioned on the smaller portion of the pin 84, and then the smaller portion of the pin 84 with the coil spring 88 thereon is inserted into the larger bore of the stepped hole 82 in the drive roller 74.

It is noted, that the outer circumference of the coil spring 88 is approximately the same size as the outer circumference of the head portion 86 of the pin 84, with both circumferences being just slightly less than the circumference of the larger bore of the stepped hole 82 to permit the head portion 86 and the coil spring 88 to slide up and down therein. However, the head portion 86 and the coil spring 88 have a larger size than the smaller bore in the stepped hole 82, where the smaller portion of the pin 84, on which the coil spring 88 is mounted, can easily slide through the smaller bore of the stepped hole 82. Thus, the pin 84 functions as a clutch to provide one way rotation of the drive roller 74, as will be discussed below.

Brackets 90 are provided in the cover portion 12, as shown in FIGS. 3, 4 and 5, to support the drive roller 74. Accordingly, the drive gear 66 is positioned on the axle portion 80 of the drive roller 74 so that a collar portion 92 of the drive gear 66 engages over the stepped hole 82 in a cylindrical portion 75 to retain the pin 84 and coil spring 88 within the stepped hole 82, as shown in FIGS. 7 and 8, as will be discussed below in greater detail. Thereafter, the bearings 94 are positioned on each of the axle portions 78, 80, and then the rack rollers 96 are positioned on an associated one of the bearings 94 to form a drive roller assembly 98. The drive roller assembly 98 is then inserted into the cover portion 12 so that the bearings 94 are positioned on the circular portions of the brackets 90 with each rack roller 96 being position between a pair of brackets 90, as best shown in FIG. 3.

The drive rack 42 is now positioned in the cover portion 12 so that the upturned flanges 100 on the opposite sides of the wing portions 60, 68 of the drive rack 42 are positioned in a rolling engagement on an associated one of the rack rollers 96, in such a manner that the holes 54 in the drive rack 42 are in alignment with the slots 30 in the cover member 12. Furthermore, it is essential that a previously determined timing mark on the drive gear 66 be in alignment with the first tooth space of the gear teeth 62 on the drive rack 42, as shown in FIG. 6, in order to perform required functions at a particular time during the operation of the lever 34, as will be explained below.

The coil spring 58 is positioned in the recess 56 so that one end 102 of the coil spring 58 is hooked on an upstanding tab 104 provided on the bight portion 48 between the holes 54, as best shown in FIG. 3. The opposite end portion 106 of the coil spring 58 is hooked on a tab 108 inside the cover portion 12, shown in FIG. 5, so that downward movement of the drive rack 42 tensions the spring 58 as will be discussed below. The threaded holes 38 in the ends of the protrusions 36 are now aligned with the associated holes 54 in the drive rack 42, and the screws 40 are inserted therein to firmly secure the drive rack 42 to the lever 34, which in turn secures the drive rack assembly 98 within the cover portion 12.

With the parts secured within the cover portion 12 as mentioned above, the drive mechanism for feeding a piece of dry ribbon soap from a supply spool will now be discussed with respect to FIGS. 1–9. The soap dispenser 10 is normally positioned as shown in FIG. 1. Accordingly, when a piece of soap is desired, the base portion 44 of the lever 34 is pushed downwardly within the recess 32 against the tension of coil spring 58. Thus, the drive rack 42 which is secured to the lever 34 is also moved downwardly within the cover portion 12 in the direction of the arrow 110 shown in FIG. 6. The downward movement of the gear teeth 62 causes the gear teeth 64 on the drive gear 66 to rotate in a counterclockwise direction as shown by the arrow 112 in FIG. 6, or when viewed from the opposite side, in a clockwise direction as shown by the same arrow 112 in FIG. 7.

The inner surface of the collar portion 92 of the drive gear 66 has a cam surface 114 provided with a step 116, as best shown in FIGS. 7 and 8. Accordingly, with the drive gear 66 in the above-mentioned timed position as shown in FIG. 6 with respect to the gear teeth 62, the coil spring 88 forces the head portion 86 of the pin 84 out of the stepped hole 82 so that the step 116 engages the head portion 86, as shown in FIG. 7. Thus, this engagement causes the drive gear 66 to rotate the drive roller 74 as the drive gear 66 is rotated by the gear teeth 62 of the drive rack 42.

During this movement, the rubber-like tubular member 76 of the drive roller 74 is held against the ribbon soap as will be further explained below, so that as drive roller 74 is rotated, a corresponding length of ribbon soap is fed down towards the opening 26 in the bottom wall 24 of the cover portion 12. This feeding action of the soap continues until the protrusions 36 engage the bottoms of the slots 30, at which time the base portion 44 of the lever 34 a position adjacent to the lower side wall 118 of the recess 32, as shown in FIG. 1, and also the lower edges 120, 122, 124 and 126 of the wing portions 60, 68 are positioned adjacent to the inner edges 128, 130, 132 and 134 of the cover portion 12, shown in FIGS. 4 and 5. At this position, as will be explained below, the ribbon soap is cut so that a predetermined length of ribbon soap is fed down and out of the soap dispenser 10.

The user now releases the base portion 44 of the lever 34 so that the tensioned spring 58 can pull upwardly on the drive rack 42 to return the lever 34 to its original position as shown in FIG. 1. During this return movement, the gear teeth 62 on the drive rack 42 drive the gear teeth 64 on the drive gear 66 so that the drive gear 66 rotates in a counterclockwise direction as indicated by arrow 136 in FIG. 8. However, the cam surface 114 within the collar portion 92 forces the head portion 86 of the pin 84 into the stepped hole 82 against the action of the coil spring 88 so that there is no engagement of the head portion 86 by the step 116. Thus, the drive roller 74 does not rotate during the upper movement of the drive rack 42 when the drive gear 66 is being rotated counterclockwise in the direction of arrow 136.

Accordingly, due to this one way clutch action of the cam surface 114 of the drive gear 66 relative to the spring loaded drive pin 84, if the lever 34 and the drive rack 42 are allowed to be retracted upwardly by the drive rack spring 58 before reaching the end of the downward stroke, the ribbon soap would not be retracted, particularly where the drive roller 74 does not rotate during the upward stroke of the drive rack 42, as mentioned above. Under this condition, if the lever 34 and drive rack 42 were to be again driven downwardly, no additional ribbon soap would be fed until the step 116 on the cam surface 114 of the drive gear 66 engages the head portion 86 of the pin 84 and continues to rotate the drive roller 74 and feed the remaining portion of the ribbon soap. Thus, this action prevents continuous uneven lengths of ribbon soap from being fed out of the soap dispenser 10, where as mentioned above, the ribbon soap is always cut in predetermined equal lengths.

As the drive rack 42 nears the end of its upward stroke as shown by arrow 138 in FIG. 9, the single gear tooth 70 on the wing portion 68 of the leg 50 of the drive rack 42 engages the single tooth 72 on the drive roller 74 to rotate the drive roller 74 back in a counterclockwise direction as shown by arrow 140 in FIG. 9, so that the end of the ribbon soap is retracted away from the cutting blade. This retraction of the end of the ribbon soap is provided in order to free the cut end of the ribbon soap from the cutting blade when the cutting blade is retracted, and thus prevents any jamming of the ribbon soap as it is fed during the next feeding cycle.

FIGS. 10 and 11 show the base portion 14 which provides the cutting action for the soap dispenser 10, as will be explained below. The base portion 14 includes a rear wall 150 having a pair of openings 152 therethrough in the upper portion thereof to receive conventional securing means, such as screws, for fastening the base portion 14 to a wall and the like. A raised block portion 154 is provided centrally on the lower portion of the rear wall 150, as best shown in FIG. 11. A recess 156 is provided in a top portion of the block portion 154 to receive a supply spool 158 having a large length of dry ribbon soap 160 rolled thereon. The bottom wall 162 of the recess 156 has an upwardly curved outer wall portion 164 to hold the supply spool 158 within the recess 156.

The block portion 154 is provided with a spaced apart pair of brackets 166 having recesses 168 at the opposite top and botton ends thereof to receive the ends of the roller springs 170. Each of the brackets 166 has a slot 172, and each roller spring 170 has a curved bend 174 therein for association with an associated slot 172. An idler roller 176 is provided having a rubber-like tubular member 178 mounted on a central portion thereof and a pair of axle portions 180 extending longitudinally outwardly from opposite ends thereof. Accordingly, the tubular member 178 of the idler roller 176 is positioned behind a lip 182 provided across the brackets 166, as best shown in FIG. 11. The axle portions 180 are snapped into the slots 172 of the brackets 166, where bumps 173 are provided near the mouths of the slots 172, and are also disposed in the circular bends 174 of the roller springs 170, as best shown in FIG. 10.

It is noted, that the idler roller 176 is mounted for free rotation thereof and can be moved inwardly and outwardly against the tension of the roller springs 170 to provide a floating action thereof, while being maintained in position between the brackets 166 by the bumps 173 at the mouths of the slots 172. Thus, during the operation of the soap dispenser 10, the ribbon soap 160 is held against the tubular member 76 of the drive roller 74 for movement therewith by the floating action engagement of the tubular member 178 of the idler roller 176, as caused by the action of the roller springs 170 in the manner mentioned above, so that a length of ribbon soap is fed out of the soap dispenser 10 as the drive roller 74 is rotated in the manner set forth above.

The cutting apparatus 184 includes a safety blade 186 preferably having a saw-tooth cutting edge 188 to pierce and properly cut the ribbon soap 160. A blade carrier 190 receives the blade 186 therein, and a blade retainer 192 is then positioned over the blade 186 so that the rear hooks 194 of the blade retainer 192 engage the rear portion 196 of the blade carrier 190. The forward latch 198 of the blade retainer 192 is then engaged into a forward recess 200 in the blade carrier 190 to firmly secure the blade 186 in a sandwich arrangement between the blade retainer 192 and the blade carrier 190 to thus form a blade assembly unit 201. It is noted, that the blade carrier 190 includes spring arms 202 on opposite sides thereof having a protrusion 204 at the ends thereof, the function of which will be discussed below.

The cutting apparatus 184 also includes a blade carrier guide 206 having an L-shaped configuration to provide an upwardly extending shorter leg portion 207. A pair of spaced apart grooves 208 are provided in the blade carrier guide 206 to receive the spaced apart rail members 210 provided on the blade carrier 190 for sliding engagement therebetween. The blade carrier guide 206 is also provided with a pair of outwardly extending resilient hook members 212, the function of which will be described below. The blade assembly unit 201 co-acts with a coil spring 215, as also will be discussed below. As shown in FIG. 3, the blade carrier guide 206 has a first slot 214 therein to receive the ribbon soap 160 therethrough, as set forth below. The blade carrier guide 206 also includes a second slot 216 in the shorter leg portion 207 thereof for receiving the cutting edge 188 of the blade 186, and further includes a pair of spaced apart spring arms 218 on opposite sides of the shorter leg portion 207. A recess 220 for receiving the end of the coil spring 215 is also provided in the blade carrier guide 206, as will be discuss below.

A transverse space 222 is provided in the block portion 154 for receiving the cutting apparatus 184 therein. A curved recess 224 is provided adjacent the space 222 for the coil spring 215. Additionally, a pair of grooves 226 are also provided in the space 222 opposite the recess 224 to slidingly receive rail members (not shown) which are aligned with the grooves 208, the rail members being provided on the bottom side of the blade carrier guide 206.

To mount the cutting apparatus 184 in the block portion 154 of the base portion 14, the coil spring 215 is first inserted into the space 222 so that it extends into the recess 224. The blade 186 is then sandwiched between the blade retainer 192 and the blade carrier 190 to form the blade assembly unit 201, as set forth above. The rail members 210 on the blade carrier 190 are then inserted in the grooves 208 of the blade carrier guide 206 so that the cutting edge 188 of the blade 186 faces towards the slot 216 in the shorter leg portion 207.

The assembled cutting apparatus 184 is inserted into the space 222 with the hook members 212 being inserted first, and with the rail members on the bottom of the blade carrier guide 206 being inserted into the grooves 226. The cutting apparatus 184 is then pushed inwardly into the space 222 until the hook members 212 snap into engagement in openings (not shown) provided therefor within the block portion 154. It is noted, that the blade carrier guide 206 can still be moved slightly in and out of the space 222 against the action of the coil spring 215. However, the blade assembly unit 201 has free in and out movement within the space 222 relative to the blade carrier guide 206, being moved against the tension of the coil spring 215, as will be explained below. The base portion 14 is now assembled, as shown in FIG. 10, and can now be connected to the cover portion 12 which will now be described below.

With the base portion 14 secured to a wall in a vertical position, as shown in FIG. 10, the pins 28 of the cover portion 12 are snapped into the elongated openings 230 provided in the bottom portion of the block portion 154 so that the cover portion 12 can pivot upwardly to a closed position. During the upward pivoting of the cover portion 12, the wing portions 60, 68 of the drive rack 42 engage over the protrusions 204 on the spring arms 202 of the blade carrier 190 and squeeze the spring arms 202 towards each other as the protrusions 204 relatively pass through tapered openings 232 in the edges of the wing portions 60, 68. The protrusions 204 then enter into a cam surface arrangement 234 provided in each wing portion 60, 68, as will be explained below. Accordingly, the wing portions 60, 68, hold the blade assembly unit 201 in tension against the action of the coil spring 215 as the edges 236, 238 of the wing portions 60, 68 ride up and down in vertical grooves 240 provided on opposite sides of the block portion 154, as set forth below.

Furthermore, the spring legs 242 extending outwardly from the rear wall 150, best shown in FIG. 11, engage downwardly against brackets 244 provided in the cover member 12. Additionally, the brackets 246 in the cover portion 12 engage against the spring arms 218 on the blade carrier guide 206 to firmly hold the blade carrier guide 206 in a fixed position while permitting the blade assembly unit 201 to freely move in and out against the action of coil spring 215. Finally, the hook 250 on the upper end of the cover portion 12, as shown in FIG. 5, snaps into the recess 252 formed in the upper part of the base portion 14, as best shown in FIGS. 10 and 11, to removably secure the cover portion 12 to the base portion 14.

To remove the cover portion 12, the cover portion 12 is pushed upwardly relative to the base portion 14 against the action of the spring legs 242 engaging on the brackets 244. The pins 28 are then moved in the elongated openings 230 until the hook 250 is released from the recess 252. Once the hook 250 is released, the cover portion 12 can be rotated downwardly on its pins 28 so that the supply spool 158 of ribbon soap 160 can be replaced when required.

Figure 12:
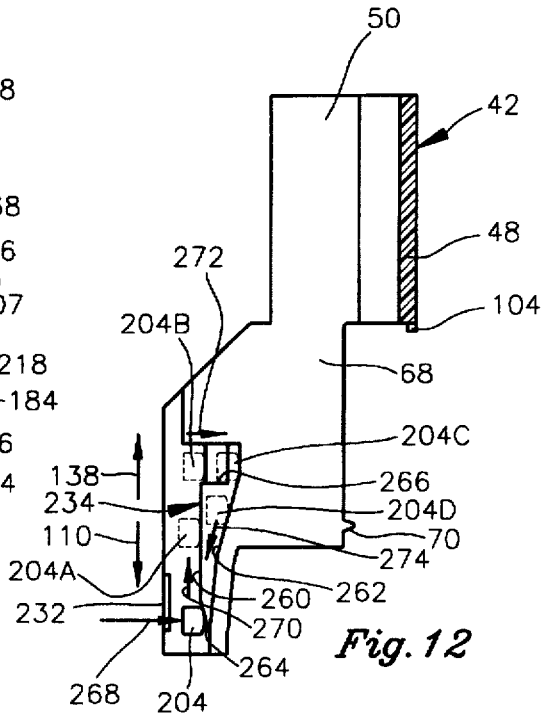
FIG. 12 is an enlarged, fragmented, side elevational view, partly in cross section, showing the inner wall of the second leg of the drive rack, shown in FIG. 9, which is provided with guide means for the cutting means mounted on the base portion.

As best shown in FIGS. 4 and 12, the cam surface arrangement 234 in each wing portion 60, 68 includes a first level 260 and a second substantially inclined level 262. The second level 262 extends outwardly from the side wall of the first level 260, so that the distance between the side walls of the first levels 260 on the wing portions 60, 68 is greater than the distance between the side walls of the second levels 262, as will be explained below. A first ramp 264 connects the first and second levels 260, 262 at the lower end, and a second tapered ramp 266 connects the first and second levels 260, 262 at the upper end thereof, as will be discussed below. In the non-operating position, when the lever 34 is in the upward position shown in FIG. 1, and the drive rack 42 is also in the upward position shown in FIGS. 6 and 9, the protrusions 204 on the spring arms 202 of the blade carrier 190 are positioned on the first ramp 264 as shown in FIG. 12. In this position, the coil spring 215 is under tension and pushes against the blade assembly unit 201 in the direction of arrow 268. It is noted, that also in this position, the spring arms 202 of the blade carrier 190 are also under tension by the inner walls of the wing portions 60, 68, so that the protrusions 204 are maintained in engagement against the first ramp 264 in alignment with the side walls of the first levels 260.

Accordingly, when the drive rack 42 is moved downwardly in the direction of arrow 110 by the user pushing down on lever 34, the drive roller 74 feeds the ribbon soap 160 through the slot 214 in the blade carrier guide 206 as set forth above. At the same time, the protrusions 204 on the blade carrier 190 relatively move upwardly on the first ramp 264 to further compress the coil spring 215 as the blade assembly unit 201 is retracted, and then further moves upwardly along the first level 260 in the direction of arrow 270 as shown by the position of protrusion 204A in FIG. 12. When the drive rack 42 reaches the bottom of its stroke, as set forth above, the blade assembly unit 201 is now positioned to cut the ribbon soap 160, as indicated by the protrusion 204B being positioned at the entrance of the second ramp 266.

Accordingly, the protrusion 204B is now positioned so that it no longer engages the walls of the first level 260, thus permitting the tensioned coil spring 215 to push the blade assembly unit 201 in a transverse direction, as indicated by the direction of arrow 272. During this transverse movement, the protrusions 204 slidingly engage against the tapered walls of the second ramp 266, best shown in FIG. 4, so that the protrusions 204 on opposite sides of the blade carrier 190 are forced towards each other to be closer together. At the same time, the spring arms 202 are being squeezed together. The blade assembly unit continues to be transversely propelled by the coil spring 215 until the protrusions engage against the walls of the second level 262, as shown by the protrusion 204C, which stops the transverse movement of the blade assembly unit 201 and the protrusions thereon. The protrusions are now in alignment with the side walls of the second levels 262. Thus, as the blade assembly unit 201 is being propelled in the direction of arrow 272, the cutting edge 188 of the blade 186 pierces and cuts the ribbon soap 160. Accordingly, during the cutting of the ribbon soap 160, the cutting edge 188 extends past the slot 214 and enters the slot 216 in the shorter leg portion 207 of the blade carrier guide 206 to insure the complete cutting of the ribbon soap 160. The cut-off length of ribbon soap 160 now falls through the bottom opening 26 of the soap dispenser 10 for use thereof.

Accordingly, when the lever 34 is released, the coil spring 58 pulls the drive rack 42 upwardly in the direction of arrow 138 to its original non-operating position shown in FIG. 1. During this return upward movement, the protrusions on the blade assembly unit 201 follow the inclined cam surface of the second level 262 in the relative downward direction of arrow 274, as indicated by protrusion 204D in FIG. 12. As the protrusion 204D relatively moves downwardly along the inclined second level 262 with respect to the wing portions 60, 68, the coil spring 215 is once again being compressed as the blade assembly unit 201 is being retracted due to the inclined surface of the second level 262.

Finally, when the drive rack 42 reaches its uppermost position placing the blade assembly unit 201 in its non-operating position on the first ramp as mentioned above, the spring arms 202 push outwardly away from each other so that the protrusions 204 are also moved outwardly away from each. Thus, the protrusions 204 are moved by tension from the side walls of the second levels 262 to engage against the side walls of the first levels 260 so that the blade assembly unit 201 is now ready for the next feed and cut cycle by repeating the above procedure.

Numerous alterations of the structures herein discussed will suggest themselves to those skilled in the art. However, it is to be understood that the present disclosure relates to a preferred embodiment of the invention which is for the purpose of illustration only, and is not to be construed as a limitation of the invention.

What is claimed is:

1. A soap dispenser for feeding, cutting and dispensing a piece of dry ribbon soap from a supply spool, comprising:

a base portion provided with holding means for holding the supply spool with the ribbon soap rolled up thereon, and cutting means coacting with a spring for cutting the ribbon soap;

a cover portion removably mounted on said base portion to enclose the supply spool therein, said cover portion being provided with feeding means for feeding a length of the ribbon soap past said cutting means prior to cutting the ribbon soap;

said feeding means including a movable member provided with cam means for retracting said cutting means against said spring to tension said spring, said cam means also releasing said cutting means when said spring is under tension so that said spring forces said cutting means into engagement with the ribbon soap for cutting off the length of ribbon soap; and said movable member being a drive rack having a bight portion and a pair of legs to define a U-shaped body.

2. A soap dispenser according to claim 1, wherein said feeding means includes a drive roller for engaging and feeding the ribbon soap.

3. A soap dispenser according to claim 2, wherein said drive roller is rotated by clutch means for rotating said drive roller in only a feed direction so that a predetermined length of the ribbon soap is fed past said cutting means for each cutting of the ribbon soap to prevent uneven cut lengths of the ribbon soap.

4. A soap dispenser according to claim 3, wherein said clutch means includes a spring biased pin disposed in a hole provided in said drive roller, said spring biased pin being in engagement with a stepped cam surface provided on a drive gear mounted on said drive roller.

5. A soap dispenser according to claim 2, wherein a tooth is provided on said drive roller, said drive rack including tooth means for engaging said drive roller tooth to rotate said drive roller back from a feed direction so that a cut end of the ribbon soap is retracted away from said cutting means to prevent jamming thereof.

6. A soap dispenser according to claim 2, wherein first teeth means are provided on said drive roller for engagingly mating with second teeth means provided on said drive rack so that said drive roller rotates when said drive rack is moved in a feed direction.

7. A soap dispenser according to claim 2, wherein said base portion is provided with an idler roller for coacting with said drive roller to maintain the ribbon soap therebetween.

8. A soap dispenser according to claim 1, wherein said drive rack is fixedly connected to a lever movably disposed on a front wall of said cover portion so that when a user pushes downwardly on said lever, said drive rack is also moved downwardly.

9. A soap dispenser according to claim 8, wherein said lever, when fully pushed downwardly by the user, positions said drive rack in a bottom stroke position so that said cam means releases said cutting means for cutting off the length of ribbon soap.

10. A soap dispenser according to claim 8, wherein spring means coact on said drive rack to return said lever to an upper start position when said lever is released by the user.

11. A soap dispenser according to claim 1, wherein said cutting means include a blade having a cutting edge mounted in a blade carrier, said blade carrier being mounted for engagement with said spring.

12. A soap dispenser according to claim 11, wherein said cutting edge of said blade is saw-toothed to pierce and cut the ribbon soap.

13. A soap dispenser according to claim 11, wherein said blade carrier includes spring arms on opposite sides thereof, said spring arms having protrusion means for engaging in said cam means of said drive rack.

14. A soap dispenser according to claim 11, wherein said blade carrier is movably mounted on a blade carrier guide for guiding movement of said blade carrier.

15. A soap dispenser according to claim 14, wherein said blade carrier guide has a slot for receiving said cutting edge of said blade.

16. A soap dispenser according to claim 14, wherein said blade carrier guide has a slot to receive the ribbon soap therethrough.

17. A soap dispenser according to claim 1, wherein at least one of said legs is provided with teeth means for feeding the ribbon soap.

18. A soap dispenser according to claim 1, wherein spring means are connected between said drive rack and said cover portion to return said drive rack to a start position.

19. A soap dispenser for feeding, cutting and dispensing a piece of dry ribbon soap from a supply spool, comprising:

a base portion provided with holding means for holding the supply spool with the ribbon soap rolled up thereon, and cutting means coacting with a spring for cutting the ribbon soap;

a cover portion removably mounted on said base portion to enclose the supply spool therein, said cover portion being provided with feeding means for feeding a length of the ribbon soap past said cutting means prior to cutting the ribbon soap;

said feeding means including a movable member provided with cam means for retracting said cutting means against said spring to tension said spring;

said cam means also releasing said cutting means when said spring is under tension so that said spring forces said cutting means into engagement with the ribbon soap for cutting off the length of ribbon soap;

said cutting means including a blade having a cutting edge mounted in a blade carrier, said blade carrier being mounted for engagement with said spring;

said blade carrier including spring arms on opposite sides thereof, said spring arms having protrusion means for engaging in said cam means of said movable member; and said cam means including a first level, and a second level inclined relatively to said first level for receiving said protrusion means, said second level extending outwardly from a sidewall of said first level, and a ramp connecting said first and second levels together so that said protrusion means travels along said first level in a feed direction, then passes through said ramp to said second level for releasing said blade carrier from under tension of said spring in order for said blade to cut off the length of ribbon soap, and then travels back along said second level for retracting said blade carrier against said spring to again tension said spring.

* * * * *